United States Patent [19]

Hein et al.

[11] 4,013,381

[45] Mar. 22, 1977

[54] PUMP CONTROL ASSEMBLY HAVING ADJUSTABLE BIASING MEANS

[75] Inventors: Allyn J. Hein, Camdenton, Mo.; William D. McMillan, Joliet; Walter Z. Ruseff, New Lenox, both of Ill.

[73] Assignee: Caterpillar Tractor Co., Peoria, Ill.

[22] Filed: Feb. 9, 1976

[21] Appl. No.: 656,235

[52] U.S. Cl. ..... 417/222; 91/378; 60/452

[51] Int. Cl.[2] ..... F04B 1/26

[58] Field of Search ..... 91/378, 506, 461; 417/218, 222; 60/445, 452

[56] References Cited

UNITED STATES PATENTS

| | | | |
|---|---|---|---|
| 2,778,314 | 1/1957 | Siver | 91/378 |
| 3,800,670 | 4/1972 | Hufeld et al. | 91/461 |
| 3,834,836 | 9/1974 | Hein et al. | 417/222 |
| 3,908,518 | 9/1975 | Bobier | 91/506 |
| 3,935,792 | 2/1976 | Dezelan et al. | 91/461 |

*Primary Examiner*—Carlton R. Croyle
*Assistant Examiner*—G. P. LaPointe
*Attorney, Agent, or Firm*—Frank L. Hart

[57] ABSTRACT

A pump control assembly for a variable displacement pump has adjustable biasing means for providing improved control of the pump.

9 Claims, 3 Drawing Figures

PUMP CONTROL ASSEMBLY HAVING ADJUSTABLE BIASING MEANS

BACKGROUND OF THE DISCLOSURE

In the operation of variable displacement pumps which have a movable swash plate, a biasing means is generally used to place a predetermined biasing force on a spool of a servo valve for controlling the movement of the swash plate by the servo valve. It has been discovered, however, that the pump can be more effectively operated if the preselected biasing means of the servo valve can be varied under different load conditions and requirements. U.S. Pat. No. 3,864,063 which issued on Feb. 4, 1975 to R. J. Martin from an application filed Sept. 11, 1973 and which is assigned to The Cessna Aircraft Co., shows a servo valve having a plurality of biasing means to provide biasing force changes.

However, since the load characteristics and requirements of a hydraulic system are so extremely variable between different hydraulic systems, it is desirable to provide means for fine tuning a servo valve to more exactly match a preselected plurality of biasing forces of a servo valve to the load characteristics and requirements of a particular system upon which the variable displacement pump and its associated controls are to be used.

This invention therefore resides in a pump control assembly for a variable displacement pump which has an adjustable biasing means for providing improved control of the pump.

DETAILED DESCRIPTION OF THE INVENTION

Figure 1:
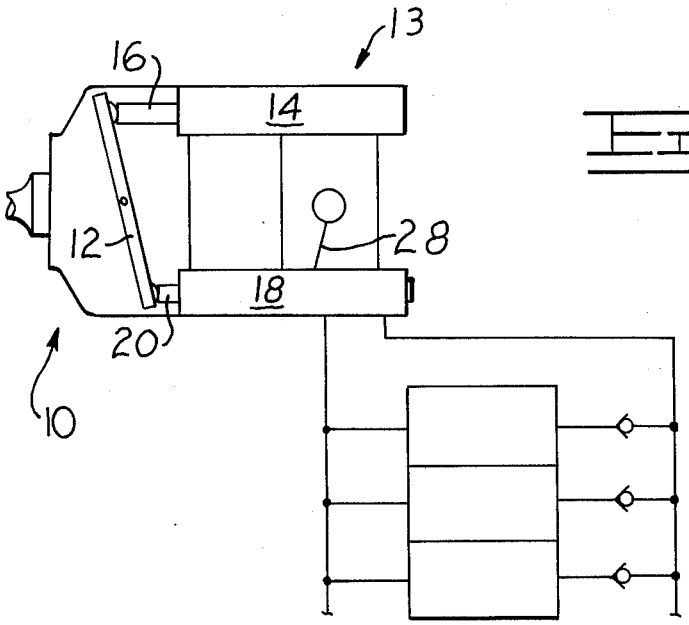
FIG. 1 is a diagrammatic view of a portion of an example hydraulic system having the variable displacement pump controls of this invention.

Referring to FIG. 1, a variable displacement pump 10 has a swash plate 12 that is movable between first and second positions for varying the discharge rate of the pump 10 between maximum and minimum. The pump control assembly 13 has a first means 14 associated with a first actuating means 16 for biasing the swash plate 12 toward one of a maximum or minimum discharge rate position, preferably a maximum discharge rate position and a second means 18 associated with a second actuating means 20 for biasing the swash plate 12 toward the other discharge rate position, preferably the minimum discharge position.

Figure 2:
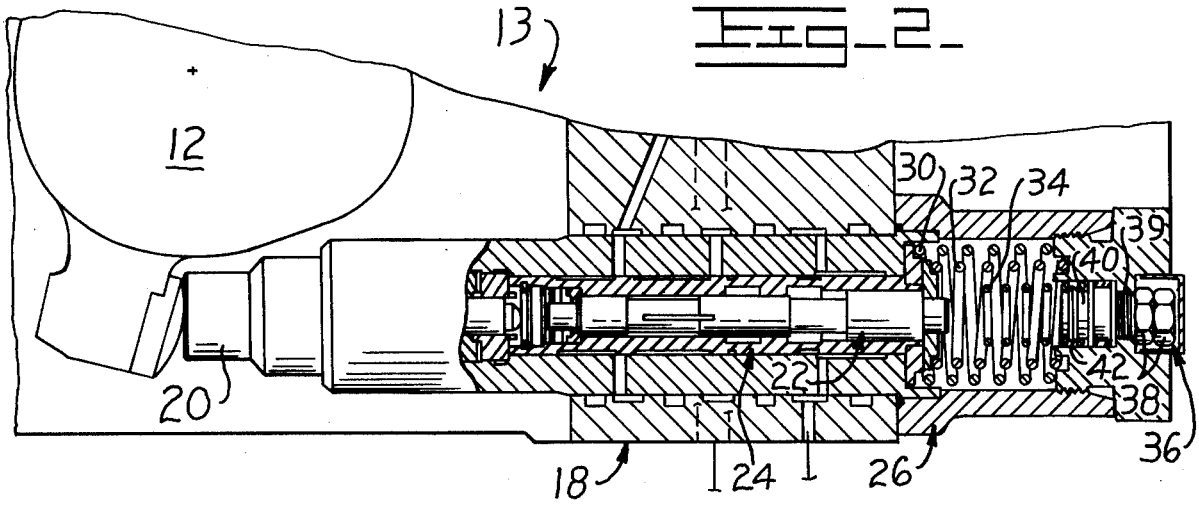
FIG. 2 is a diagrammatic view of a portion of the variable displacement pump and the controls of FIG. 1.

Referring to FIG. 2, the second means 18 of the pump control assembly 13 is a servo valve which has a movable spool valve 22 positioned within a movable sleeve 24 which in turn is positioned within a housing 26. The spool 22 and sleeve 24 are communicable with a pump discharge pressure signal passing from the pump 10 to the servo valve 18 via line 28 (FIG. 1).

Such variable displacement pumps 10 and pump control systems 13 having a swash plate controlled by a servo valve 18, and which have a movable spool valve 22 and sleeve 24 are known in the art, as for example that shown in U.S. Pat. No. 3,834,836 which issued Sept. 10, 1974 to Hein et al from an application filed Mar. 1, 1973 and which is assigned to Caterpillar Tractor Co.

These servo valves 18 have a first biasing means 30 for biasing the sleeve in a first direction and a second biasing means 32 for biasing the spool 22 in the first direction.

The control assembly 13 of this invention has a third biasing means 34, for example a spring, positioned within the housing 26 in the pathway of the movable spool 22 for compression by the biasing of the spool in the first direction. The third biasing means 34 is associated with means 36 for controllably changing the position of the third biasing means 34 in the pathway of the spool 22.

The third biasing means 34 can be connected to the position changing means 36 or connected to and movable with the spool 22.

The third biasing means 34 is of a length sufficient for requiring contact and compression of the second biasing means 32 by the spool 22 prior to contact and compression of the third biasing means 34 during movement of the spool toward the biasing means 32, 34.

The biasing properties of the second and third biasing means are different relative one to the other. After the other elements of the servo valve 18 are constructed and the load characteristics are determined, one skilled in the art can readily match the biasing capabilities that are desirable.

The third biasing means 34 is preferably a helical spring having an axis substantially coaxial with the axis of the spool 22 in the installed position.

The position changing means 36 comprises an element having threads 39 mateable with threads of the housing 26 and is oriented for linear movement along the pathway of the spool 22 in directions toward and from the spool 22. Lock nuts 38 can be associated with the element for releasably maintaining the position changing means 36 at preselected positions.

Figure 3:
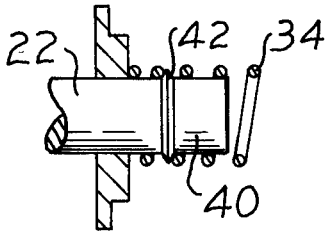
FIG. 3 is a diagrammatic view of another embodiment of a portion of the apparatus.

The third biasing means 34 has a guide element 40 connected to one of the spools 22 (FIG. 3) or the position changing means 36 and extending into the third biasing means 34 in the installed position. A flange 42 extends outwardly from the guide element 40 and into the third biasing means 34 in the installed position for connecting the third biasing means to the guide element 40. It should be understood, however, that other means can be used to connect the third biasing means to the position adjusting means 36 or to spool 22.

In the operation of the apparatus, fluid pressure urges the spool against the second biasing means 32. This force increases and overcomes the biasing force exerted by the second biasing means 32 and the spool 22 continues to move. At a preselected distance of movement of the spool 22, while compressing the second biasing means 32, the spool starts compressing the third biasing means 34 which opposes further movement of the spool 22.

By so constructing the apparatus of this invention the location of the spool 22 upon initial biasing of the third biasing means can be adjusted to further match the operation of the servo valve 18 to the forces of the hydraulic system. The means 36 can be turned one direction for applying this additional biasing force to the spool at a first preselected location of the spool during its travel in a direction toward the biasing means and toward the other direction for applying this additional biasing force to the spool at a second, later location in the pathway of said travel of the spool 22.

Other aspects, objects, and advantages of this invention can be obtained from a study of the drawings, the disclosure, and the appended claims.

What is claimed is:

1. In a pump control assembly for moving a swash plate of a variable displacement pump between maximum and minimum discharge rate positions, said pump having inlet and outlet means, said control assembly having a first means having a movable first actuating means for biasing the swash plate toward one of the maximum or minimum discharge rate positions and a second means having a movable second actuating means for biasing the swash plate toward the other discharge position, said second means having a spool and a sleeve movable within a housing and communicable with a pump discharge pressure signal for biasing the second actuating means, a first biasing means for biasing the sleeve in first direction, and a second biasing means for biasing the spool in the first direction, the improvement comprising:

third biasing means positioned in the pathway of the movable spool for biasing the spool in the first direction, said third biasing means including:

a guide element connected to one of the spools or the position changing means and extending into the third biasing means in the installed position;

a flange extending from the guide element and into the third biasing means in the installed position for connecting the third biasing means to one of said position changing means or spool; and means for controllably changing the biasing position of the third biasing means in the pathway of the spool.

2. Apparatus, as set forth in claim 1, wherein the third biasing means is connected to the position changing means.

3. Apparatus, as set forth in claim 1, wherein the third biasing means is connected to and movable with the spool.

4. Apparatus, as set forth in claim 1, including means for releasably maintaining the position changing means at preselected positions.

5. Apparatus, as set forth in claim 1, wherein the third biasing means is of a length sufficient to require compression of the second biasing means by the spool prior to the spool being at a position for compressing the third biasing means.

6. Apparatus, as set forth in claim 1, wherein the third biasing means is a spring.

7. Apparatus, as set forth in claim 1, wherein the second and third biasing means are springs each having different preselected properties relative one to the other.

8. Apparatus, as set forth in claim 1, wherein the third biasing means is a helical spring having an axis substantially coaxial with the axis of the spool in the installed position.

9. In a pump control assembly for moving a swash plate of a variable displacement pump between maximum and minimum discharge rate positions, said pump having inlet and outlet means, said control assembly having a first means having a movable first actuating means for biasing the swash plate toward one of the maximum or minimum discharge rate positions and a second mans having a movable second actuating means for biasing the swash plate toward the other discharge position, said second means having a spool and a sleeve movable within a housing and communicable with a pump discharge pressure signal for biasing the second actuating means, a first biasing means for biasing the sleeve in a first direction, and a second biasing means for biasing the spool in the first direction, the improvement comprising:

third biasing means positioned in the pathway of the movable spool for biasing the spool in the first direction; and means for controllably changing the biasing position of the third biasing means in the pathway of the spool, said means comprising an element having threads mateable with threads of the housing oriented for linear movement along the pathway of the spool in directions toward and from the spool.

* * * * *